US011504560B1

(12) United States Patent
Schroeder et al.

(10) Patent No.: US 11,504,560 B1
(45) Date of Patent: Nov. 22, 2022

(54) SYSTEMS AND METHODS FOR ELECTRIC OUTLET FIRE DETECTION AND PREVENTION

(71) Applicant: UIPCO, LLC, San Antonio, TX (US)

(72) Inventors: Eric Schroeder, San Antonio, TX (US); Manfred Amann, San Antonio, TX (US); Jess Gingrich, San Antonio, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 277 days.

(21) Appl. No.: 16/871,712

(22) Filed: May 11, 2020

Related U.S. Application Data

(63) Continuation of application No. 15/824,908, filed on Nov. 28, 2017, now Pat. No. 10,758,755.
(Continued)

(51) Int. Cl.

| | |
|---|---|
| ***A62C 3/16*** | (2006.01) |
| ***G08B 17/06*** | (2006.01) |
| ***G08B 19/00*** | (2006.01) |
| ***G08B 21/20*** | (2006.01) |
| ***A62C 31/00*** | (2006.01) |
| ***A62C 35/11*** | (2006.01) |
| ***A62C 37/40*** | (2006.01) |

(Continued)

(52) U.S. Cl.
CPC ..... *A62C 3/16* (2013.01); *A62C 31/00* (2013.01); *A62C 35/11* (2013.01); *A62C 37/40* (2013.01); *G08B 17/06* (2013.01); *G08B 19/00* (2013.01); *G08B 21/20* (2013.01); *G08B 25/00* (2013.01); *A62C 99/0027* (2013.01); *A62C 99/0036* (2013.01)

(58) Field of Classification Search
CPC ..... A62C 3/16; A62C 35/11; A62C 37/40; G08B 17/06; G08B 19/00; G08B 21/20; G08B 25/00
See application file for complete search history.

(56) References Cited

U.S. PATENT DOCUMENTS 4,711,307 A 12/1987 Harold
6,122,678 A * 9/2000 Eckel ..... H05B 47/105 340/567

(Continued)

*Primary Examiner* — John A Tweel, Jr.
(74) *Attorney, Agent, or Firm* — Plumsea Law Group, LLC

(57) ABSTRACT

An electric outlet fire detection and prevention system may comprise a temperature sensor and an electromagnetic interference (EMI) sensor. A processor within the system may monitor the measurements of the temperature and EMI sensors to determine that a fire has developed in an electric outlet box. The processor may then actuate a triggering mechanism in a cartridge containing fire extinguishing material such that the fire extinguishing material is dispersed in the outlet box. The fire extinguishing material may extinguish a developing fire and prevent the fire from spreading further. The processor may also be coupled with a server, which is configured to analyze measurements of the temperature and the EMI sensors and generate a building profile. When the server determines that any measurements deviate from the building profile, the server may instruct the processor to actuate the triggering mechanism and/or notify an electronic device associated with the building.

20 Claims, 4 Drawing Sheets

Related U.S. Application Data

(60) Provisional application No. 62/429,026, filed on Dec. 1, 2016.

(51) Int. Cl.
*G08B 25/00* (2006.01)
*A62C 99/00* (2010.01)

(56) References Cited

U.S. PATENT DOCUMENTS

| | | | | |
|---|---|---|---|---|
| 6,552,888 | B2 * | 4/2003 | Weinberger | H01R 13/713 361/57 |
| 10,758,755 | B1 * | 9/2020 | Schroeder | A62C 35/13 |
| 2002/0038199 | A1 | 3/2002 | Blemel | |
| 2004/0216895 | A1 | 11/2004 | Boyce et al. | |
| 2010/0025053 | A1 | 2/2010 | Chesley | |
| 2011/0094758 | A1 | 4/2011 | Burkhart et al. | |
| 2011/0297401 | A1 | 12/2011 | Rennie et al. | |
| 2012/0285708 | A1 | 11/2012 | Bildstein et al. | |
| 2014/0085092 | A1 * | 3/2014 | Fadell | G08B 21/18 340/603 |
| 2014/0177737 | A1 * | 6/2014 | Vasquez | H02H 5/04 375/257 |
| 2015/0204561 | A1 * | 7/2015 | Sadwick | G05D 23/1905 236/1 C |
| 2017/0234562 | A1 * | 8/2017 | Ribbich | G05D 23/1934 700/277 |
| 2017/0345527 | A1 | 11/2017 | Royston | |
| 2018/0050230 | A1 | 2/2018 | Toland | |
| 2018/0115131 | A1 | 4/2018 | Kohen | |
| 2020/0044883 | A1 * | 2/2020 | Telefus | H05B 47/10 |

* cited by examiner

300

400

SYSTEMS AND METHODS FOR ELECTRIC OUTLET FIRE DETECTION AND PREVENTION

CROSS-REFERENCE TO RELATED APPLICATION(S)

This application is a continuation of co-pending U.S. patent application Ser. No. 15/824,908, filed on Nov. 28, 2017, titled "Systems and Methods for Electric Outlet Fire Detection and Prevention", which application claims priority to U.S. Provisional Patent Application Ser. No. 62/429,026, filed on Dec. 1, 2016, the disclosures of which applications are hereby incorporated by reference in their entirety.

TECHNICAL FIELD

This application relates generally to the field of smart home systems, and more specifically to systems and methods for electric outlet fire detection and prevention and systems and methods for identifying obfuscated water leaks in walls and subfloors.

BACKGROUND

The leading cause of house fires is electrical malfunctions, for example, electrical arcs and sparks in the electrical utility circuits. Parallel electrical arcs and sparks may form when current flows through one conductor to the next through insulation. This type of current, also known as leakage current, may travel in arcs and sparks to ease its passage through the insulation. Electric arcs and sparks may form when a single wire is damaged to withstand the current, and the current may travel in arcs and sparks through the damaged portion and into the insulation surrounding the damaged portion. The fire from these sparks and arcs may spread into other components within the outlet and items outside the outlet, thereby creating an easy source for a house fire.

The conventional safety features, such as a circuit breaker, may not be sufficient to mitigate potential fire hazards. For example, when there is an electrical arcing, the current or arcing may not be high enough to trigger a circuit breaker to trip. In other words, a significant amount of arcing may be required to trip a circuit breaker, and by the time the circuit breaker is tripped, the outlet box may have already developed a fire, which may then spread outside the box. Once the fire has spread, tripping the circuit breaker to create an open circuit may not help in extinguishing the fire.

SUMMARY

Therefore, there is a need for an outlet, which can detect fire potentially developing in an outlet and take mitigating steps to extinguish the fire thereby preventing the fire from spreading. Furthermore, there is a need for outlets, which can communicate the status of fire/no fire to a user or a supervisory monitoring system or entity.

Embodiments of the systems and methods described herein solve the aforementioned and other problems. The embodiments describe a smart outlet that has sensors and a processor to monitor the temperature, humidity, electromagnetic interference (EMI) in the outlet box. In response to the processor determining that a fire has developed in the smart outlet, the processor triggers a fire-mitigating system, for example a capsule with fire-extinguishing material, such that the fire extinguishing material is dispersed in the smart outlet to extinguish the existing fire and prevent potential fires.

In an exemplary embodiment, a temperature sensor configured to measure temperature in an outlet box and generate a first set of one or more measurements; an electromagnetic interference (EMI) sensor configured to measure the electromagnetic interference in the outlet box and generate a second set of one or more measurements; a cartridge containing a fire extinguishing material and an actuator configured to disperse the fire extinguishing material in the outlet box; a processor configured to determine a potential fire hazard based upon at least one of the first and the second sets of one or more measurements; and upon a determination of the potential fire hazard, transmit an instruction to the actuator to disperse the fire extinguishing material in the outlet box.

In another embodiment, a computer system comprises an outlet box, comprising a temperature sensor configured to measure temperature in the outlet box and generate a first set of one or more measurements; an electromagnetic interference (EMI) sensor configured to measure the electromagnetic interference in the outlet box and generate a second set of one or more measurements; a cartridge containing a fire extinguishing material and an actuator configured to dispense the fire extinguishing material in the outlet box; and a processor coupled with a server and the outlet box, wherein the processor is configured to transmit the first and the second set of one or more measurements to the server; transmit an instruction to the actuator to dispense the fire extinguishing material in the outlet box; and a server coupled with the processor, wherein the server is configured to receive the first and the second set of one or more measurements; determine a potential fire hazard based upon at least one of the first and the second sets of one or more measurements satisfying a pre-determined threshold; and generate the instruction to dispense the fire extinguishing material in the outlet box; and transmit the instruction to the processor.

BRIEF DESCRIPTION OF THE DRAWINGS

The accompanying drawings constitute a part of this specification and illustrate embodiments of the subject matter disclosed herein.

DETAILED DESCRIPTION

Figure 1:
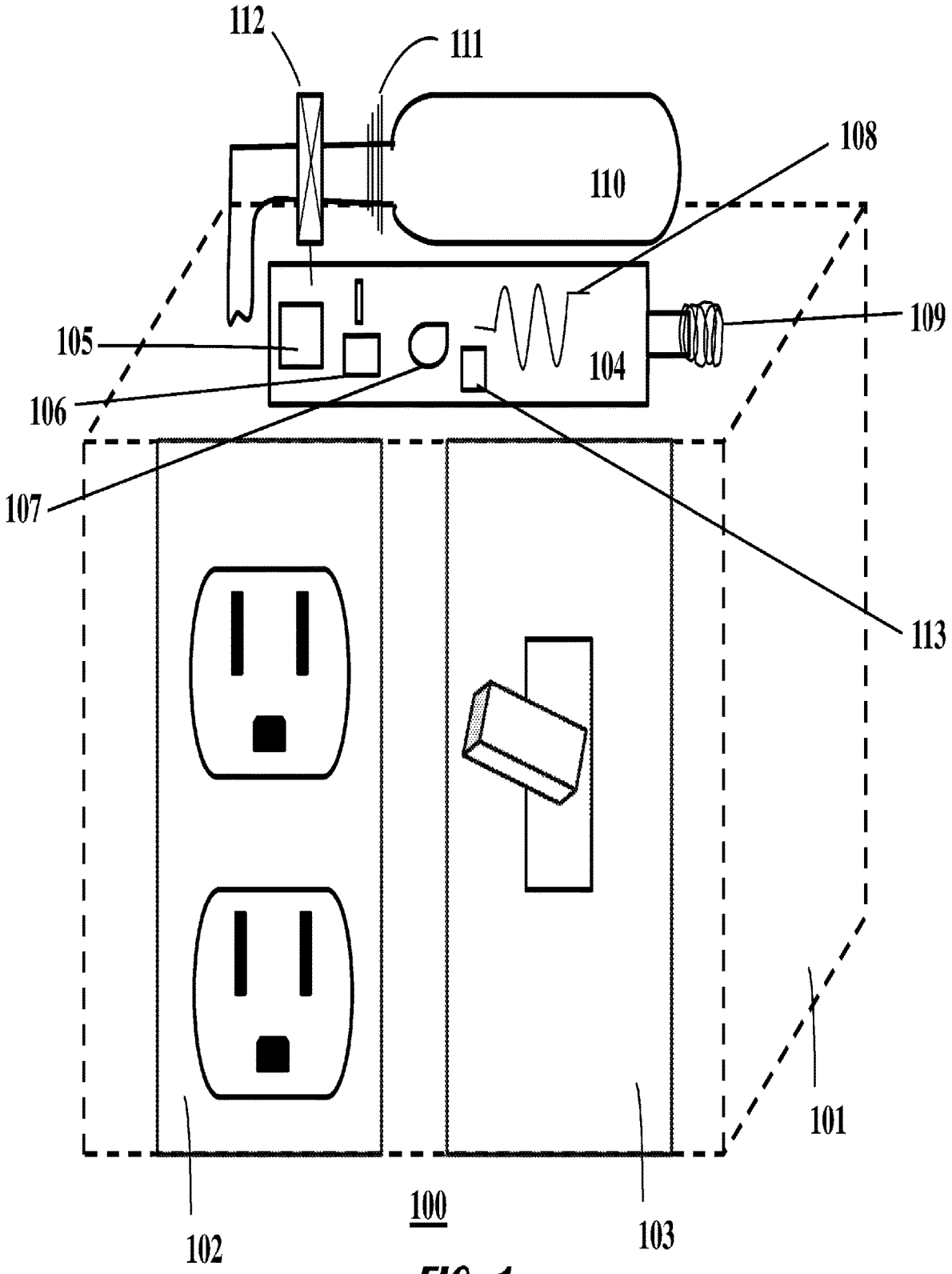
FIG. 1 shows an exemplary electrical outlet box, according to an exemplary embodiment.

Reference will now be made to the illustrative embodiments illustrated in the drawings, and specific language will be used here to describe the same. It will nevertheless be understood that no limitation of the scope of the claims or this disclosure is thereby intended. Alterations and further modifications of the inventive features illustrated herein, and additional applications of the principles of the subject matter illustrated herein, which would occur to one skilled in the relevant art and having possession of this disclosure, are to be considered within the scope of the subject matter disclosed herein. The present disclosure is here described in detail with reference to embodiments illustrated in the drawings, which form a part here. Other embodiments may be used and/or other changes may be made without departing from the spirit or scope of the present disclosure. The illustrative embodiments described in the detailed description are not meant to be limiting of the subject matter presented here.

Embodiments disclosed herein describe a smart outlet box that may monitor measurements from one or more sensors to detect a fire hazard and trigger a fire extinguishing mechanism. The outlet box may comprise a processor that controls the operations of the one or more sensors and the fire extinguishing mechanism. The one or more sensors may comprise a temperature sensor, an electromagnetic interference (EMI) sensor, and a humidity sensor. The temperature sensor may measure the temperature in the outlet box and relay the temperature data to the processor. The EMI sensor may measure the spectrum and the amount of electromagnetic interference in the outlet box and relay the interference data to the processor. The humidity sensor may measure the humidity in the outlet box and relay the humidity data to the processor. The outlet box may further comprise a communications component to communicate with a user and/or a server.

The processor may monitor the measurements from the one or more sensors and determine a likelihood of a fire hazard. For example, the processor may receive measurement data indicating a rapid increase in temperature combined with the presence of electromagnetic interference with significantly higher frequencies than the household supply current of 60 Hz. Based on the measurement data, the processor may determine that a fire is developing in the outlet box, send a notification to a user and/or a server, and trigger a fire extinguishing mechanism. The processor may determine that the fire is developing based upon historical data such as the normal operating temperature for a particular outlet box. The processor may compile the historical data, may receive the historical data from a server, or may be preprogrammed with the historical data. Even though the embodiments described herein illustrate "household" as a residential building, a skilled artisan will appreciate that the use of "household" applies to all buildings and properties at risk of fire (e.g., residential, commercial, light commercial, and industrial properties).

The fire extinguishing mechanism may comprise a cartridge containing one or more fire extinguishing material such as inert gases, carbon dioxide (CO2), foam, or any other type of fire extinguishing material. Based upon determining that a fire is developing in the outlet box, the processor may trigger one or more actuators in the fire extinguishing mechanism such that the fire extinguishing material is dispersed within the outlet box thereby extinguishing the developing fire. To aid the fire extinguishing material, the outlet box is designed such that the fire extinguishing material does not escape from the outlet box. For example, the bottom portion of the outlet box may not have holes that may allow the fire extinguishing material to fall through (e.g., dispense the extinguishing material).

The communications component may transmit the sensor measurements such as the temperature, humidity, and the presence of electrical arcing to a mobile app. The mobile application may present the measurements in a user readable format such that the user may observe the behavior of the outlet box and make decisions whether or not to switch off the outlet box. For example, the mobile application may visually represent a measurement going out of range and may present the user with options to switch off the outlet box or to trigger a safety mechanism such as the carbon dioxide capsule.

The outlet box may also aid a user in detecting water leakage and seepage in the walls. A slow leakage, for example, may not be easily detectable by human eye and the leakage may already have caused considerable amount of damage when it is detected. The humidity sensor may measure the humidity in the outlet box, thereby detecting minute changes in humidity. The processor in the outlet box may monitor the humidity measurement and may indicate a user or a server of the humidity measurement is out of the ordinary. For example, the processor may instruct the communications component to transmit a message to the user's smartphone that an unusual amount of humidity has been detected in the outlet box.

A central server may aggregate measurements from a plurality of outlet boxes distributed within a geographical area. Based on aggregating the measurements, the central server may calculate particular trends of measurements. For example, if the outlet boxes in a particular neighborhood block have been consistently measuring higher temperatures or higher level of electrical arcing, the server may determine that power distribution system in that neighborhood may be malfunctioning. In another example, if the outlet boxes in a house are consistently measuring a higher amount of humidity, the server may determine that the plumbing system in the house may have gotten old and leaky.

Although the embodiments disclosed herein describe an outlet box and components therein, one ordinarily skilled in the art appreciates that outlet box and the components may not be grouped together. For example, one or more components may be retrofitted in an existing outlet box. Furthermore, one ordinarily skilled in the art also appreciates that the one or more components may be incorporated into other electric components in a household or industrial supply circuits such as circuit breakers, distributors, and lighting panels. Furthermore, the one or more components may be incorporated into consumer and industrial electrical devices such as clothing irons, vacuum cleaners, televisions, and industrial robots.

FIG. 1 shows an exemplary electric outlet box 100, according to an exemplary embodiment. The electric outlet box 100 may comprise a housing 101, which may be configured to be within a drywall. The electrical outlet box may further comprise an electrical outlet 102, an electrical switch 103, a printed circuit board (PCB) 104, and a cartridge 110 containing fire extinguishing material.

The housing 101 may be constructed of any type of material such as metals, metallic alloys, and non-metals. Non-metals may include plastic or any other type of non-metal. The material forming the housing may be fire retardant or at least not readily inflammable. The housing 101 may be configured to be connected to a drywall with one or more studs. In some embodiments, the electric outlet box 100 may not include housing, and the individual components may be configured to be retrofitted into a conventional electrical outlet box.

The electrical outlet 102 may comprise one or more interfaces for electrical components to be connected to the electrical outlet box 100. The electrical outlet 102 may include a three pronged (shown) or a two pronged interface (not shown). The electrical switch 103 may be configured to control the electrical outlet 102 or any other components connected to the electrical outlet box 100.

The printed circuit board 104 may include one or more components configured to monitor the temperature, the electromagnetic interference, and humidity in the electric outlet box 100 and to actuate one or more safety features. The PCB may include a processor 105, a communications component 106, a humidity sensor 107, an electromagnetic interference (EMI) sensor 108, a temperature sensor 109, and a current sensor 113. The one or more components may be printed on the printed circuit board 104 or may be connected to the printed circuit board 104.

The processor 105 may include any type of processor programmed to control the operation of the electrical outlet box 100. The processor 105 may include a memory configured to store one or more programs for the processor 105. The memory may be configured to operate as a main memory and/or a cache memory as the processor runs the one or more programs. The memory may further include a storage configured to store values measured by one or more sensors in the electric outlet box 100. The storage may further be configured to store the results generated by the processor 105 during the operation of the electric outlet box 100.

The communications component 106 may include one or more communication antennas and one or more communication chipsets. The communications component may use communication protocols such as Wi-Fi, ZigBee®, Bluetooth®, and variants of Bluetooth®. The communication antennas may receive communication signals using these protocols and the communication chipset may process the signals to retrieve the data contained in the communication signals. The communication chipset may also generate communication signals based on the data to be transmitted, and the antenna may transmit the communication signals using the aforementioned protocols. The communications chipset may receive the data to be transmitted from the processor 105, and may transmit the received data to the processor 105.

The humidity sensor 107 may measure the level of humidity in the electric outlet box 100. The humidity sensor 107 may be any type of humidity sensor such as a capacitive humidity sensor, a resistive humidity sensor, and a thermal conductive humidity sensor. In some instances, the humidity sensor 107 may continuously measure the level of humidity in the electric outlet box 100 and continuously send the measured level of humidity to the processor 105. In other instances, the humidity sensor 107 may measure the level of humidity after an interval of time and send the measured level of humidity to the processor 105. The processor 105 may dynamically determine the interval of time and send the instructions with the determined interval of time to the humidity sensor 107. The processor 105 may determine the interval of time based on the measurements from one or more sensors in the electric outlet box 100. In addition or in the alternative, the processor 105 may also determine the interval of the time based on instructions received from a server and/or a user. In some implementations, the humidity sensor 107 may include a local storage configured to store the measurements made by the humidity sensor 107. The humidity sensor 107 may send the stored measurements to the processor 105 when requested by the processor 105.

The electromagnetic interference (EMI) sensor 108 may detect electrical arcs and sparks in electric outlet box 100. Electrical arcs and sparks may occur when the electric current in the outlet box 100 quits its intended path and travels through components such as the insulation. For example, parallel electrical arcs and sparks may form when current flows through one conductor to the next through the insulation. This type of current (also known as leakage current) may travel in arcs and sparks to ease its passage through the insulation. Series arcs and sparks may form when a single wire is damaged to withstand the current, and the current may travel in arcs and sparks through the damaged portion and into the insulation surrounding the damaged portion. The electrical arcs and sparks may have a relatively large spectrum, that is, they may include a wide range of frequencies. Particularly, the electrical arcs and sparks may have much higher frequencies than the normal operating frequency of 60 Hz of a typical household current supply. The EMI sensor 108 may include one or more antennas tuned to detect electromagnetic interference of higher frequencies. The EMI sensor 108 or the processor 105 may implement a band-pass or a high-pass filter to examine the spectrum of the signal detected by the antennas. The EMI sensor 108 or the processor may determine that an electric arc or spark is present in the outlet box 100 if there is enough energy in the power spectrum above a threshold frequency. The EMI sensor 108 may also identify when an appliance, that is plugged into the outlet box 100, begins to arc. This arc may be conducted back to the outlet box 100 junction and radiated. This arc may be less intense than an arc in the outlet box 100 itself but may provide resolvable information to the processor 105 on the health or risk of the electrical equipment connected to the outlet box 100.

The EMI sensor 108 may continuously measure the EMI in the electric outlet box 100 and continuously send the measured EMI to the processor 105. In other instances, the EMI sensor 108 may measure the EMI after an interval of time and send the measured EMI to the processor 105. The processor 105 may dynamically determine the interval of time and send the instructions with the determined interval of time to the EMI sensor 108. The processor 105 may determine the interval of time based on the measurements from one or more sensors in the electric outlet box 100. In addition or in the alternative, the processor 105 may also determine the interval of the time based on instructions received from a server and/or a user. In some implementations, the EMI sensor 108 may include a local storage configured to store the attributes of the signals detected by the one or more antennas. The EMI sensor 108 may send the stored attributes to the processor 105 when requested by the processor 105.

The temperature sensor 109 may measure the temperature of the electric outlet box 100. The temperature sensor 109 may be any type of temperature sensor such as a thermocouple, a resistance temperature detector (RTD), a negative temperature coefficient (NTC) thermistor, and a semiconductor based temperature sensor. In some instances, the temperature sensor 109 may continuously measure the temperature of the electric outlet box 100 and continuously send the measured temperature to the processor 105. In other instances, the temperature sensor 109 may measure the temperature after an interval of time and send the measured temperature to the processor 105. The processor 105 may dynamically determine the interval of time and send the instructions with the determined interval of time to the temperature sensor 109. The processor 105 may determine the interval of time based on the measurements from one or more sensors in the electric outlet box 100. In addition or in the alternative, the processor 105 may also determine the interval of the time based on instructions received from a server and/or a user. In some implementations, the temperature sensor 109 may include a local storage configured to store the measurements made by the temperature sensor 109.

The temperature sensor 109 may send the stored measurements to the processor 105 when requested by the processor 105.

The cartridge 110 may contain a fire extinguishing material. The fire extinguishing material may include fire extinguishing gases or fluids, such as carbon dioxide (CO2), Nitrogen, Argon, Neon. In addition or in the alternative, the fire extinguishing material may include substances such as foam or powder and/or combination of other solid, semi-solid, and gaseous material. The cartridge 110 may include a piercing terminal 111. The piercing terminal 111 may be actuated by an instruction from the processor 105. The piercing terminal 111 may include one or more mechanisms which, when actuated, may generate a pathway for the fire extinguishing material to escape from the cartridge 110 and be discharged in the outlet box 100. The cartridge 110 may also include a pintle or a digital valve 112, which may control the flow of the fire extinguishing material from the cartridge 110 to the outlet box 100. The processor 105 may control of the operation of the pintle or digital valve 112. The cartridge 110 may be sized and positioned to deliver the fire extinguishing material inside the wall to suppress an in wall fire or block a fire from spreading inside the walls.

The current sensor 113 may measure the amount of current being drawn from the outlet box 100 by one or more appliances connected to the outlet box 100. In some instances, the current sensor 113 may continuously measure the current drawn from the electric outlet box 100 and continuously send the measurements to the processor 105. In other instances, the current sensor 113 may measure the current drawn after an interval of time and send the measured current to the processor 105. The processor 105 may dynamically determine the interval of time and send the instructions with the determined interval of time to the current sensor 113. The processor 105 may determine the interval of time based on the measurements from one or more sensors in the electric outlet box 100. In addition or in the alternative, the processor 105 may also determine the interval of the time based on instructions received from a server and/or a user. In some implementations, the current sensor 113 may include a local storage configured to store the measurements made by the current sensor 113. The current sensor 113 may send the stored measurements to the processor 105 when requested by the processor 105.

In operation, the processor 105 may receive and monitor the measurement data from the humidity sensor 107, the EMI sensor 108, and the temperature sensor 109. The processor 105 may generate a normal operating profile based on the received measurement data. In addition or in the alternative, the processor 105 may receive measurements made by sensors in neighboring outlet boxes via the communications component 106. Furthermore, the processor 105 may receive other data and instructions from a user or a server via the communications component 106 and may use the received data and instructions to generate the normal operating profile. The processor 105 may adjust the normal operating profile for attributes such as seasons, time of the day, location of the outlet box 100 in the house, and/or other attributes. For example, during the summer months, the normal operating profile may include a temperature of a higher range compared to the winter months. In an example of a residential environment, the normal operating profile of the outlet box 100 in the outer walls of a house may include higher fluctuations of temperature and/or humidity compared to the outlet boxes 100 in the inner walls of the house. The normal operating profile the outlet box 100 in the bathroom or kitchen may include a humidity of a higher range compared to the outlet boxes 100 in the bedroom. In some embodiments, the processor 105 may be preprogrammed with the normal operating profile.

The processor 105 may further receive and monitor the measurement data from the humidity sensor 107, the EMI sensor 108, and the temperature sensor 109 and may determine whether one or more measurements deviate from the normal operating profile. If the processor 105 determines that one or more measurements have deviated from the normal operating profile, the processor may 105 send a notification to a user or a server via the communications component 106. For example, the normal operating profile may have a maximum threshold value for the temperature and/or the rate of change of the temperature. If the temperature exceeds one or more these thresholds, the processor 105 may send a notification to a user that there may be a potential fire hazard. Furthermore, the processor 105 may use a combination of measurements to determine if there is a potential fire hazard. For example, the processor 105 may determine a presence of electrical arcing based on the measurements from the EMI sensor 108, and may confirm the presence of electrical arcing by observing a rate of rise of temperature as measured by the temperature sensor 109.

In response to determining that a potential fire hazard exists, the processor 105 may actuate the piercing terminal 111 and the digital valve 112 such that the fire extinguishing material flows out of the cartridge 110 to the electric outlet box 100. The fire extinguishing material may extinguish the electrical sparks and arcs, as well as fire caused by the electrical arcs and sparks. To actuate the piercing terminal 111 and the digital valve 112, the processor may send instructions to actuation mechanisms associated with each of the piercing terminal 111 and the digital valve 112. For example, if the piercing terminal 111 is actuated by an electrical motor, the processor 105 may send an instruction to turn on the electrical motor.

The processor 105 may implement a first lower threshold level for sending a user notification. For example, the processor 105 may send a warning notification to a server or a user that there may be a potential fire hazard in the outlet box 100 based on the measurements by one or more of the sensors. These measurements may not exceed a higher threshold to indicate that a fire is imminent or has developed, but a lower threshold such that there may be a possibility of fire or the outlet box is malfunctioning. The user may then act upon the warning notification to diagnose and rectify the problem in the outlet box 100.

The processor 105 may further send a notification to the user based on the measurement of the current sensor 113. For example, the processor may send a notification to the user of abnormally higher amount of current is being drawn from the outlet box 100. The higher amount of current being drawn may take place when several appliances are plugged into the outlet box. A higher amount of current may compromise the components of the outlet box. For example, a higher amount of current may cause overheating of the insulation, and the insulation may melt or turn brittle prematurely. Therefore, the processor 105, by notifying the user of higher amount of current being drawn, may allow the user to take appropriate corrective actions such as unplugging one or more appliances from the outlet box 100.

Figure 2:
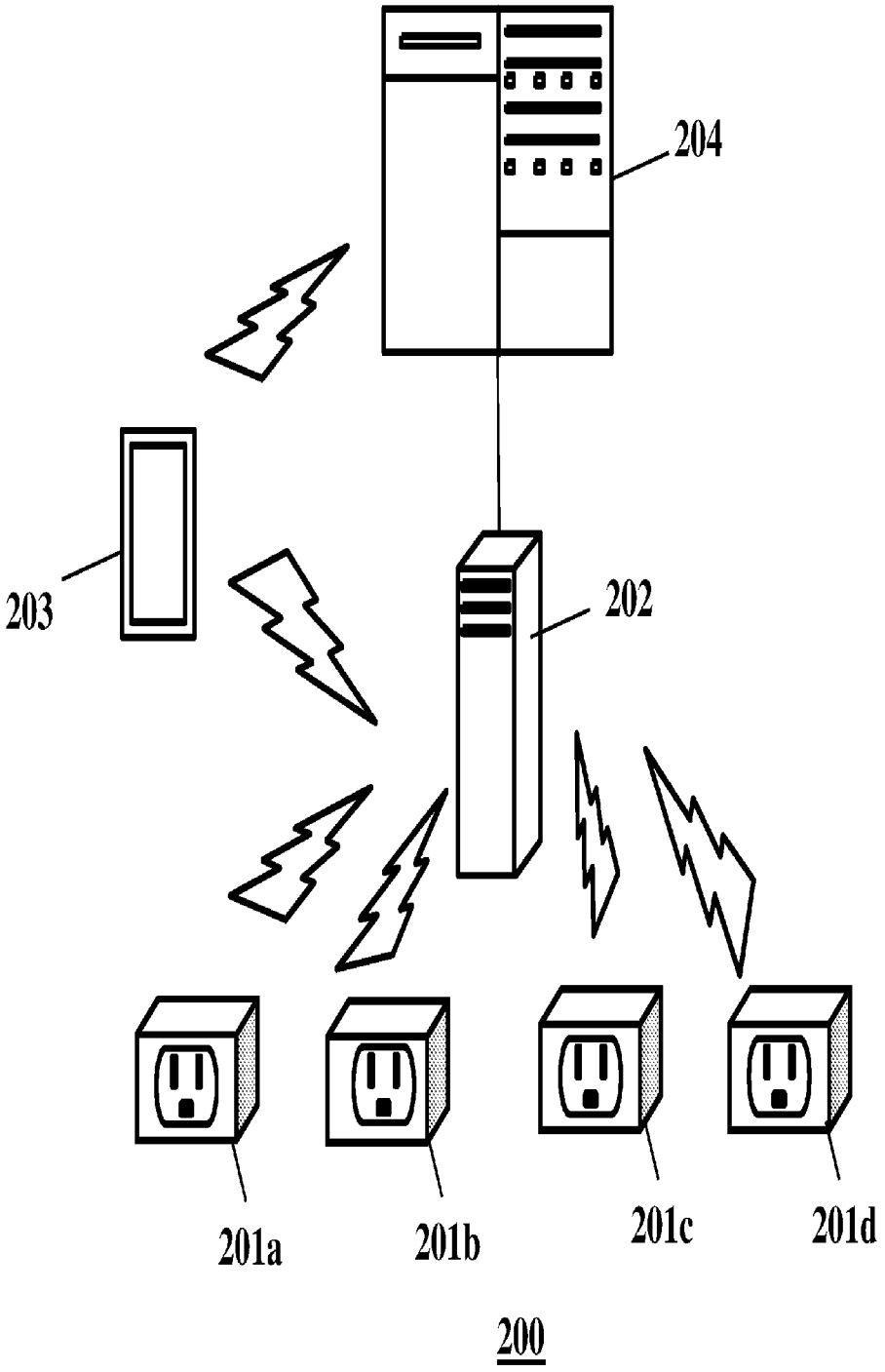
FIG. 2 shows an exemplary system for aggregating sensor measurements from and controlling a plurality of outlet boxes, according to an exemplary embodiment.

FIG. 2 shows an exemplary system 200 for aggregating sensor measurement data from and controlling a plurality of outlet boxes 201. The system may comprise a household server 202, a remote server 204, and a smartphone 203. The household server 202 may be a desktop computer, a laptop computer, a tablet, a smartphone, and/or a router. The remote server 204 may be one or more server computers that may be connected to the household server 202 and the smartphone 203 through a wired or wireless connection. The smartphone 203 may be any kind of user device capable of providing information to and receiving instructions from a user.

The plurality of outlet boxes 201 may communicate with the household server 202 or the smartphone 203 through wired connection or through wireless connection such as Wi-Fi, ZigBee®, and Bluetooth® and its variants. The outlet boxes 201, which may include one or more sensors such as a temperature sensor, a humidity sensor, and electromagnetic interference (EMI) sensor, may send the sensor measurement data to the household server 202 and/or the smartphone 203. The household server 202 and/or the smartphone 203 may receive the data and render the received data to a user via the respective user interfaces. The outlet boxes 201 may further send notifications of malfunctions, potential fires, actual fires, and deployment of one or more fire extinguishing mechanisms to the household server 202 and/or the smartphone 203. The household server 202 and/or the smartphone 203 may generate alerts, such as audible alerts, to the user based on the received notification. The household server 202 and/or the smartphone 203 may receive one or more instructions from the user and transmit the instructions to one or more of the outlet boxes 201. The one or more instructions may include, for example, a user request to deploy the fire extinguishing mechanism. The smartphone 203 and/or the household server 202 may include a dedicated application to render the data from and receive instructions for the plurality of outlet boxes 201.

The household server 202 or the smartphone 203 may transmit the sensor measurement data to the remote server 204. The remote server 204 may use the measurement data to generate a normal operating profile for one or more of the outlet boxes 201. Furthermore, the remote server 204 may generate one or more instructions for one or more of the outlet boxes 201. The one or more instructions may include, for example, an instruction to deploy the fire extinguishing mechanism, or an instruction to notify a user of a potential hazard (e.g., transmitting a notification to the smartphone 203). The one or more instructions may be transmitted directly to the one or more outlet boxes (e.g., to the processor of the outlet box) or transmitted to the remote server 204 to be transmitted to the one or more outlet boxes.

One or more of the household server 202, the smartphone 203, and the remote server 204 may determine trends in the sensor measurement data. For instance, each of the humidity sensors in the outlet boxes 201 may measure different levels of humidity at different times. If there is a water leakage in the house, the household server 202 may utilize the measurements to determine the source and direction of the leakage. For instance, the humidity sensor in the outlet box 201*a* may measure a high humidity, followed by the humidity sensor in the outlet box 201*b* that may measure a high humidity after a first interval of time, followed by the humidity sensor in the outlet box 201*c* that may measure a high humidity after a second interval of time greater than the first interval of time. Based on these temporal measurements, the household server may determine that the source of the water leakage is close to the outlet box 201*a* and the leak is moving from the outlet box 201*a* to the outlet box 201*c*. Furthermore, the household server 202 may utilize the temperature measurements by the temperature sensors in the outlet boxes 201 over time to determine a fault in the insulation system of the house. For instance, if during the winter months, the temperature sensor in the outlet box 201*a* consistently measures a lower temperature than that of the outlet box 201*b*, which in turn measures consistently lower temperature than the temperature sensor in the outlet box 201*c*, the household server may determine that the fault in the insulation system may be closer to the outlet box 201*a*.

In an embodiment, different readings and measurements received from the outlet boxes (201*a-d*) may be collected and locally stored by the household server 202. The household server 202 may then aggregate and periodically transmit the aggregated data to the remote server 204. The remote server 204 may then use a variety of big data analytics techniques and compare historical readings from a building to comparable buildings (e.g., national average or other buildings within a pre-determined proximity to the building) or a historical profile of the building itself in order to identify appliance malfunctions within the building. For example, the remote server 204 may analyze historical trends of humidity readings collected within a pre-determined period of time (e.g., one year) and determine that, compared with other similar buildings (e.g., buildings of same size and/or within the same zip code), the readings indicate humidity levels that are consistently higher than normal. The remote server 204 may then notify the building owner (via the smartphone 203) and/or a third party responsible for maintaining the building (e.g., a server associated with building maintenance). In other embodiments, the remote server 204 may conduct similar studies for temperature and/or EMI readings. The remote server 204 may also generate a building profile based on different readings (from different outlet boxes within the building). For example, the remote server 204 may generate a historical heat map for a building that includes all temperature data received from outlet boxes installed in different rooms for a pre-determined period of time. Subsequently, the remote server 204 may determine that temperature readings for bedroom 1 (described in FIG. 3) is consistently higher than other rooms within the building described in FIG. 3. The remote server 204 may compare the temperature reading with the historical heat map of the building and determine that the temperature of bedroom 1 deviates (e.g., deviates more than a pre-determined threshold) from its historical temperature trend. Consequently, the remote server 204 may conclude that the HVAC air canal connected to bedroom 1 may need maintenance; the remote server 204 may then notify the building owner or a third-party server associated with maintaining the building.

Figure 3:
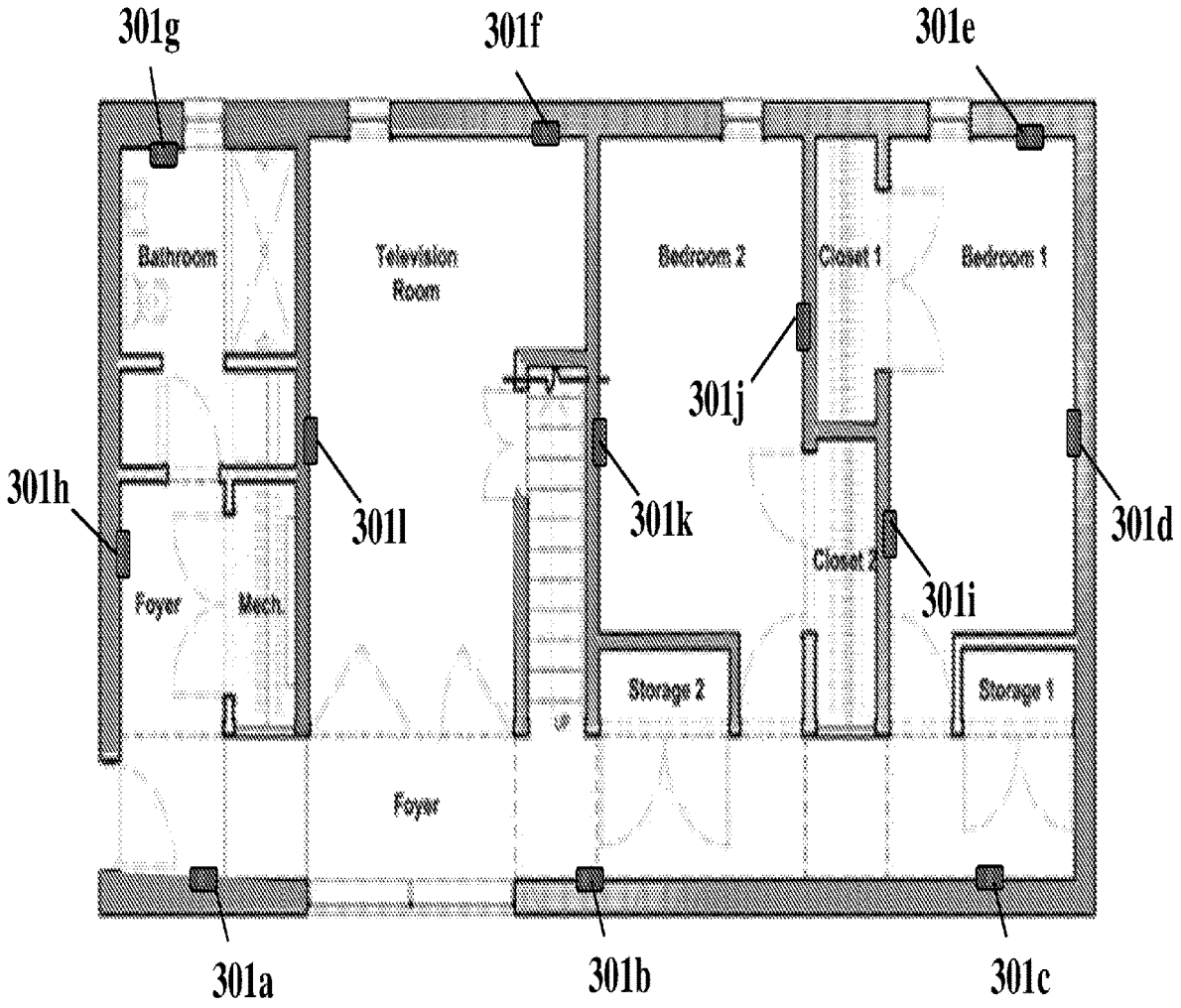
FIG. 3 shows an exemplary system to determine a humidity distribution of a building, according to an exemplary embodiment.

FIG. 3 shows an exemplary system 300 to measure the humidity of various portions of a building, according to an exemplary embodiment. The system 300 may be used in any type of buildings such as a house, an office, and a business. The system may comprise a plurality of outlet boxes 301. Each of the plurality of outlet boxes 301 may include a humidity sensor.

Each of the plurality of outlet boxes 301 in a building may measure the humidity of the associated wall throughout the day. A computer (not shown) of the system 300 may monitor the measurements of the humidity in the building throughout the day. For example, each of the outlet boxes 301 may measure the humidity of the associated wall 10 times a second (i.e. a frequency of 10 Hz), or may measure the humidity of the associated wall every 100 seconds (i.e. a frequency of 0.01 Hz). The system 300 may use the measurements to estimate real-time humidity distribution within the walls. The system 300 may render the humidity distribution through a user interface (for example a GUI). In the GUI, the system 300 may apply a color code, for example, red to indicate abnormal high humidity and blue to indicate a normal humidity level.

In operation, the system 300 may determine an increased humidity at a portion of the building such as a bathroom. The system 300 may further determine that the increased humidity may be indicative of a water leak. Once detected, the system 300 may notify a user of the location of the potential leak. The system 300 may further query a residential water flow monitor system to reveal if there is an unknown water flow is/has occurred at the building to corroborate the humidity sensor reading of the corresponding outlet boxes 301. The user may then take an appropriate response to eliminate the incipient leak before significant damage occurs.

Figure 4:
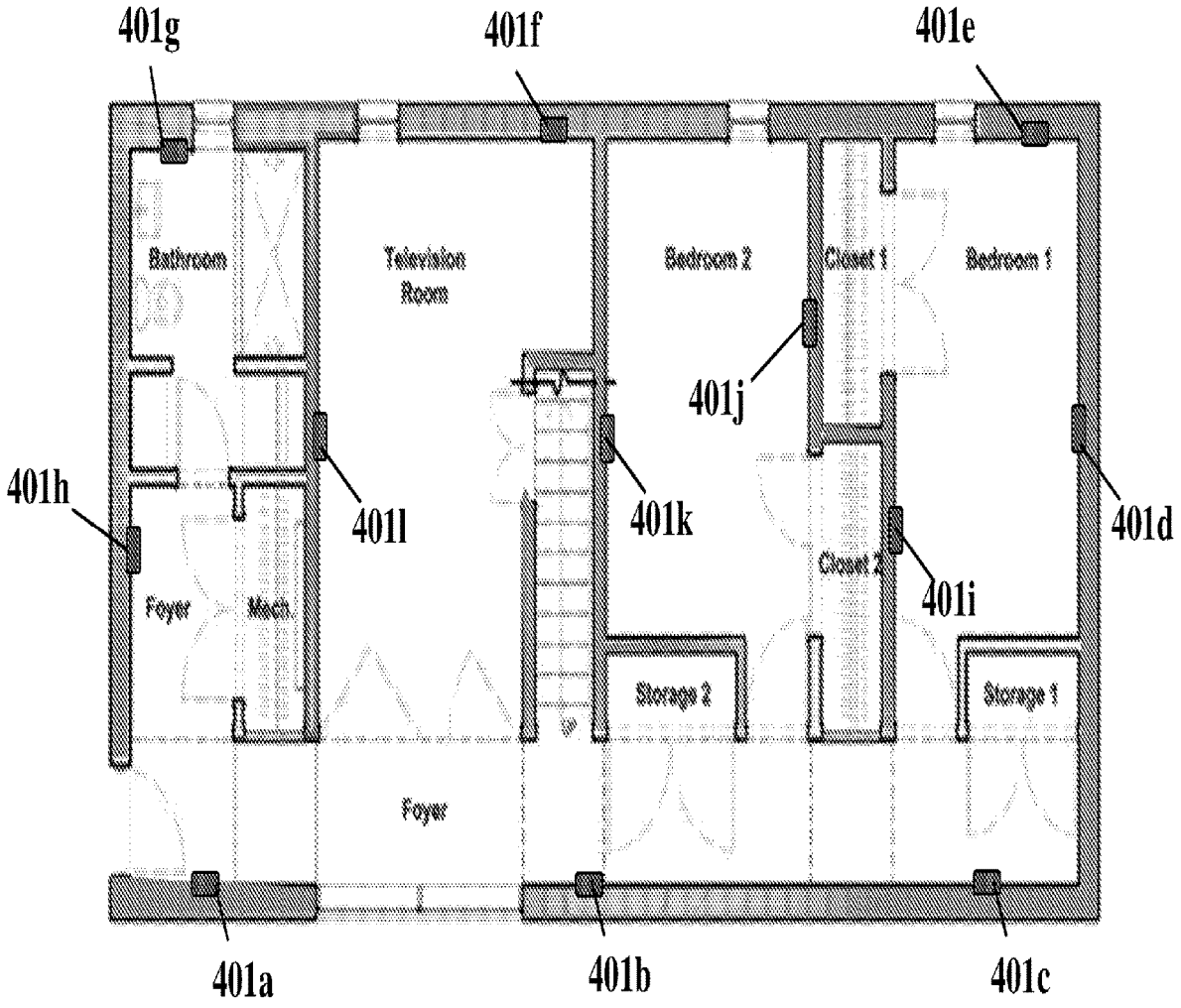
FIG. 4 shows an exemplary system to determine a temperature distribution of a building, according to an exemplary embodiment.

FIG. 4 shows an exemplary system 400 to measure the temperature of various portions of a building, according to an exemplary embodiment. The system 400 may be used for any type of building such as a house, an office, and a business. The system may comprise a plurality of outlet boxes 401. Each of the plurality of outlet boxes 401 may include a temperature sensor.

Each of the plurality of outlet boxes 401 in a building may measure the temperature of the associated wall throughout the day. A computer (not shown) of the system 400 may monitor these measurements of the temperature in the building throughout the day. For example, each of the outlet boxes 401 may measure the temperature of the associated wall 10 times a second (i.e. a frequency of 10 Hz), or may measure the temperature of the associated wall every 100 seconds (i.e. a frequency of 0.01 Hz). The system 400 may use the measurements to estimate real-time temperature distribution within the walls. The system 400 may render the temperature distribution through a user interface (for example a GUI). In the GUI, the system 400 may apply a color code, for example, red to indicate abnormal high temperature and blue to indicate a normal temperature level.

In operation, the system 400 may determine the temperature of a wall to be higher than the normal level. At certain levels of the higher temperature, the system 400 may determine that the higher temperature is due to the lack of insulation and may notify a user accordingly. At higher levels, the system 400 may determine a fire condition has occurred. Furthermore, the system 400 may monitor the rate of rise of the temperature distribution from all the outlets 401. Based on these measurements, the system 400 may determine where the fire may be occurring in the wall and may trigger a suppression response from the outlets 401 at the appropriate locations in the building. The system 400 may further notify the user and/or the emergency services of the developing fire.

The foregoing method descriptions are provided merely as illustrative examples and are not intended to require or imply that the steps of the various embodiments must be performed in the order presented. The steps in the foregoing embodiments may be performed in any order. Words such as "then," "next," etc. are not intended to limit the order of the steps; these words are simply used to guide the reader through the description of the methods. Although operations may be described as a sequential process, many of the operations can be performed in parallel or concurrently. In addition, the order of the operations may be re-arranged. A process may correspond to a method, a function, a procedure, a subroutine, a subprogram, and the like. When a process corresponds to a function, the process termination may correspond to a return of the function to a calling function or a main function.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of this disclosure or the claims.

Embodiments implemented in computer software may be implemented in software, firmware, middleware, microcode, hardware description languages, or any combination thereof. A code segment or machine-executable instructions may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

The actual software code or specialized control hardware used to implement these systems and methods is not limiting of the claimed features or this disclosure. Thus, the operation and behavior of the systems and methods were described without reference to the specific software code being understood that software and control hardware can be designed to implement the systems and methods based on the description herein.

When implemented in software, the functions may be stored as one or more instructions or code on a non-transitory computer-readable or processor-readable storage medium. The steps of a method or algorithm disclosed herein may be embodied in a processor-executable software module, which may reside on a computer-readable or processor-readable storage medium. A non-transitory computer-readable or processor-readable media includes both computer storage media and tangible storage media that facilitate transfer of a computer program from one place to another. A non-transitory processor-readable storage media may be any available media that may be accessed by a computer. By way of example, and not limitation, such non-transitory processor-readable media may comprise RAM, ROM, EEPROM, CD-ROM or other optical disk storage, magnetic disk storage or other magnetic storage devices, or any other tangible storage medium that may be used to store desired program code in the form of instructions or data structures and that may be accessed by a computer or processor. Disk and disc, as used herein, include compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and/or instructions on a non-transitory processor-readable medium and/or computer-readable medium, which may be incorporated into a computer program product.

The preceding description of the disclosed embodiments is provided to enable any person skilled in the art to make or use the embodiments described herein and variations thereof. Various modifications to these embodiments will be readily apparent to those skilled in the art, and the generic principles defined herein may be applied to other embodiments without departing from the spirit or scope of the subject matter disclosed herein. Thus, the present disclosure is not intended to be limited to the embodiments shown herein but is to be accorded the widest scope consistent with the following claims and the principles and novel features disclosed herein.

While various aspects and embodiments have been disclosed, other aspects and embodiments are contemplated. The various aspects and embodiments disclosed are for purposes of illustration and are not intended to be limiting, with the true scope and spirit being indicated by the following claims.

The invention claimed is:

1. A system for measuring humidity in a building, comprising:

a computer;

a plurality of outlet boxes in communication with the computer, each outlet box of the plurality of outlet boxes comprising:

an electrical outlet;

a humidity sensor configured to measure a level of humidity associated with the outlet box;

a communications component; and a processor coupled with the communications component, wherein the processor is configured to periodically measure a humidity level associated with a wall in which the outlet box is located; and wherein the computer is configured to receive the measured humidity levels from the plurality of outlet boxes and determine a water leak at a location in the building corresponding to an outlet box associated with an increased humidity level;

wherein the computer is further configured to:

measure a humidity level associated with a first outlet box of the plurality of outlet boxes after a first time interval;

measure a humidity level associated with a second outlet box of the plurality of outlet boxes after a second time interval, the second time interval being greater than the first time interval; and determine a location of a leak in the building corresponding to a location of at least the first outlet box.

2. The system according to claim 1, wherein the humidity levels from the plurality of outlet boxes are measured at least once every 100 seconds.

3. The system according to claim 1, wherein the computer is further configured to determine that the leak is moving from the location of the first outlet box towards the second outlet box.

4. The system according to claim 1, wherein the computer is further configured to:

aggregate the measured humidity levels from the plurality of outlet boxes;

transmit the aggregated humidity levels to a remote server in communication with the computer.

5. The system according to claim 4, wherein the remote server is configured to analyze historical trends associated with the aggregated humidity levels and compare the aggregated humidity levels over a predetermined time period for the building to at least one other building having a similar size.

6. The system according to claim 1, wherein the computer is further configured to receive the measured humidity levels from the plurality of outlet boxes and generate a humidity distribution of the walls in the building through a graphical user interface.

7. The system according to claim 1, wherein each outlet box of the plurality of outlet boxes further comprises a temperature sensor configured to measure a temperature associated with the outlet box;

wherein the processor is configured to periodically measure a temperature associated with the wall in which the outlet box is located; and wherein the computer is configured to receive the measured temperatures from the plurality of outlet boxes and determine a maintenance issue at a location in the building corresponding to an outlet box associated with a temperature that deviates from a normal temperature profile by a predetermined threshold.

8. A system for measuring temperature in a building, comprising:

a computer;

a plurality of outlet boxes in communication with the computer, each outlet box of the plurality of outlet boxes comprising:

an electrical outlet;

a temperature sensor configured to measure a temperature associated with the outlet box;

a communications component; and a processor coupled with the communications component, wherein the processor is configured to periodically measure a temperature associated with a wall in which the outlet box is located;

wherein the computer is configured to receive the measured temperatures from the plurality of outlet boxes and determine a maintenance issue at a location in the building corresponding to an outlet box associated with a temperature that deviates from a normal temperature profile by a predetermined threshold;

wherein the computer is further configured to receive the measured temperatures from the plurality of outlet boxes and generate a temperature distribution of the walls in the building through a graphical user interface.

9. The system according to claim 8, wherein the maintenance issue includes a lack of insulation.

10. The system according to claim 8, wherein the maintenance issue includes a problem with a heating, ventilation, and air conditioning (HVAC) air canal.

11. The system according to claim 8, wherein the graphical user interface is configured to apply a color code to the temperature distribution, the color code including a first color to indicate an abnormal high temperature and a second color different from the first color to indicate a normal temperature level.

12. The system according to claim 8, wherein the computer is further configured to receive the measured temperatures from the plurality of outlet boxes and determine a fire condition based on a rate of rise of a temperature distribution from the plurality of outlet boxes.

13. The system according to claim 12, wherein the computer is further configured to determine a location of the fire condition by determining a location in the building corresponding to an outlet box associated with a temperature that exceeds a predetermined level.

14. The system according to claim 13, wherein each outlet box of the plurality of outlet boxes further comprises a fire extinguishing material; and wherein the computer is configured to trigger a suppression response from one or more outlet boxes of the plurality of outlet boxes at the location of the fire condition to deploy the fire extinguishing material.

15. The system according to claim 8, wherein each outlet box of the plurality of outlet boxes further comprises a humidity sensor configured to measure a level of humidity associated with the outlet box;

wherein the processor is configured to periodically measure a humidity level associated with the wall in which the outlet box is located; and wherein the computer is configured to receive the measured humidity levels from the plurality of outlet boxes and determine a water leak at a location in the building corresponding to an outlet box associated with an increased humidity level.

16. A method of monitoring measurements from a plurality of sensors associated with a plurality of outlet boxes in a building, the method comprising:

providing a plurality of outlet boxes in a building, the plurality of outlet boxes being in communication with a computer, each outlet box of the plurality of outlet boxes comprising: an electrical outlet; a temperature sensor configured to measure a temperature associated with the outlet box; a humidity sensor configured to measure a level of humidity associated with the outlet box; a communications component; and a processor coupled with the communications component;

periodically measuring, by the processor, at least one of a temperature or a humidity level associated with a wall in which the outlet box is located;

receiving, by the computer, one or more of the measured temperatures or humidity levels from the plurality of outlet boxes;

determining, by the computer, a maintenance issue at a location in the building corresponding to an outlet box associated with a temperature or a humidity level that deviates from a normal operating profile by a predetermined threshold;

receiving one or more of the measured temperatures or humidity levels from the plurality of outlet boxes; and generating at least one of a humidity distribution or a temperature distribution of the walls in the building through a graphical user interface.

17. The method according to claim 16, wherein the maintenance issue includes at least one of a lack of insulation, a problem with a heating, ventilation, and air conditioning (HVAC) air canal, a fire condition, or a water leak.

18. The method according to claim 16, wherein each outlet box of the plurality of outlet boxes further comprises a fire extinguishing material; and upon determining that the maintenance issue is a fire condition, the method further comprising triggering a suppression response from one or more outlet boxes of the plurality of outlet boxes at the location of the fire condition to deploy the fire extinguishing material.

19. The method according to claim 16, wherein the graphical user interface is configured to apply a color code to the humidity distribution and/or the temperature distribution, the color code including a first color to indicate an abnormal high humidity and/or temperature and a second color different from the first color to indicate a normal humidity level and/or temperature level.

20. The method according to claim 16, further comprising notifying a user of the maintenance issue.

* * * * *